US006001141A

United States Patent [19]

Quigley

[11] Patent Number: 6,001,141

[45] **Date of Patent: *Dec. 14, 1999**

[54] FUEL ADDITIVE

[75] Inventor: Robert Quigley, Bracknell, United Kingdom

[73] Assignee: Ethyl Petroleum Additives, Ltd., Bracknell, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/748,234

[22] Filed: Nov. 12, 1996

[51] Int. Cl.[6] ..... C10L 1/18; C10L 1/22

[52] U.S. Cl. ..... 44/330; 44/386; 44/412; 44/418

[58] Field of Search ..... 44/330, 307, 386, 44/308, 418, 412

[56] References Cited

U.S. PATENT DOCUMENTS

| | | | |
|---|---|---|---|
| 1,296,902 | 3/1919 | Backhaus | 44/308 |
| 2,632,695 | 3/1953 | Landis | 44/66 |
| 2,854,323 | 9/1958 | Shen | 44/66 |
| 2,854,324 | 9/1958 | Shen | 44/66 |
| 3,088,815 | 5/1963 | Haney | 44/71 |
| 3,117,931 | 1/1964 | Westlund, Jr. | 232/51.5 |
| 3,183,070 | 5/1965 | Udelhofen | 44/71 |
| 3,273,981 | 9/1966 | Furey . | |
| 3,681,038 | 8/1972 | Gaydasch | 44/418 |
| 3,877,888 | 4/1975 | Gaydasch | 44/418 |
| 4,059,414 | 11/1977 | Holtz et al. | 44/58 |
| 4,098,708 | 7/1978 | Stuebe | 252/51.5 A |
| 4,105,418 | 8/1978 | Mohnhaupt | 44/408 |
| 4,105,571 | 8/1978 | Shaub et al. . | |
| 4,113,442 | 9/1978 | Hoff et al. | 44/66 |
| 4,123,373 | 10/1978 | Brois et al. | 252/48.6 |
| 4,138,227 | 2/1979 | Wilson et al. | 44/393 |
| 4,198,931 | 4/1980 | Malec | 123/1 A |
| 4,243,538 | 1/1981 | Shubkin | 252/51.5 A |
| 4,244,829 | 1/1981 | Coupland | 252/56 R |
| 4,253,876 | 3/1981 | Godar et al. | 106/14.42 |
| 4,336,149 | 6/1982 | Erdman | 252/56 R |
| 4,354,855 | 10/1982 | Sweeney | 44/56 |
| 4,364,743 | 12/1982 | Erner | 44/388 |
| 4,375,360 | 3/1983 | Wash-check | 44/53 |
| 4,401,439 | 8/1983 | Graiff et al. | 44/63 |
| 4,444,567 | 4/1984 | Burns et al. | 44/78 |
| 4,491,455 | 1/1985 | Ishizaki et al. | 44/62 |
| 4,509,954 | 4/1985 | Ishizaki et al. | 44/62 |
| 4,512,903 | 4/1985 | Schlicht | 252/51.5 A |
| 4,551,152 | 11/1985 | Sung | 44/78 |
| 4,609,376 | 9/1986 | Craig et al. | 44/53 |
| 4,617,026 | 10/1986 | Shaub et al. | 44/70 |
| 4,639,256 | 1/1987 | Axelrod et al. | 44/71 |
| 4,816,037 | 3/1989 | Horodysky et al. | 44/53 |
| 5,080,690 | 1/1992 | Baillargeon et al. | 44/391 |
| 5,194,068 | 3/1993 | Mohr et al. | 44/391 |
| 5,338,470 | 8/1994 | Hiebert | 252/51.5 A |
| 5,352,377 | 10/1994 | Blain | 252/51.5 R |

FOREIGN PATENT DOCUMENTS

| | | |
|---|---|---|
| 85803 | 9/1982 | European Pat. Off. . |
| 555006 | 8/1993 | European Pat. Off. . |
| 0608149 | 7/1994 | European Pat. Off. . |
| 0635558 | 1/1995 | European Pat. Off. . |
| 0680506 B1 | 1/1997 | European Pat. Off. . |
| 1496077 | 12/1977 | United Kingdom . |
| WO 92/09673 | 6/1992 | WIPO . |
| WO 93/21143 | 10/1993 | WIPO . |
| 0017160 | 4/1994 | WIPO . |
| WO 95/03377 | 2/1995 | WIPO . |
| 95/33805 | 12/1995 | WIPO . |

OTHER PUBLICATIONS

R. Caprotti, et al., *Additive Technology as a Way to Improve Diesel Fuel Quality,* SAE Paper No. 922183 (Oct. 1992).

WPI Acc No: 78–20530A/11. Abstract only, for JP 53011907.

*Primary Examiner*—Margaret Medley

*Attorney, Agent, or Firm*—Dennis H. Rainear; Thomas Hamilton

[57] ABSTRACT

Low sulfur content fuel compositions containing additive compounds are described which exhibit improved lubricity. The additive compounds include a carboxylic acid substituted by at least one hydroxyl group, derivatives of the carboxylic acid substituted by at least one hydroxyl group, and an ester which is the reaction product of a carboxylic acid which does not contain any hydroxy-substitution in the acid backbone and an alkanolamine.

19 Claims, No Drawings

FUEL ADDITIVE

BACKGROUND OF THE INVENTION

The present invention relates to the use of certain compounds to improve the lubricating properties of low sulfur-content fuels and to fuels and additive concentrates comprising the compounds.

Sulfur contained in fuel, for example middle distillate fuels such as diesel fuel and jet fuel, is said to constitute a serious environmental hazard. Hence strict regulations limiting the amount of sulfur which may be present in such fuels have been introduced. Unfortunately, fuels having a suitably low sulfur content exhibit very poor inherent lubricity and this can lead to problems when the fuel is used. For example, the use of low sulfur fuel in diesel engines frequently results in damage to the fuel injector pump which relies on the natural lubricating properties of the fuel to prevent component failure. There is therefore a need to improve the lubricating properties of low sulfur fuels.

EP-A-0608149 discloses the use of an ester as an additive in a liquid hydrocarbon compression-ignition fuel oil for reducing consumption of the fuel oil.

WO 92/09673 discloses additives which are the reaction products of (1) anhydrides and/or poly-acids and (2) aminoalcohols or amino/alcohol/amides with long chain hydrocarbyl groups attached used to improve the low-temperature properties of distillate fuels.

U.S. Pat. No. 4,617,026 (Shaub et al.) discloses the use of hydroxyl-containing esters of a monocarboxylic acid and a glycol or trihydric alcohol to reduce fuel consumption in automobiles.

U.S. Pat. No. 3,681,038 (Gaydasch) discloses middle distillate fuel compositions containing N,N-dialkylricinoleamide pour point depressants.

U.S. Pat. No. 5,194,068 (Mohr et al.) discloses fuel compositions containing small amounts of an ester of a mono- and/or poly-carboxylic acid with an alkyl alkanolamine or alkyl aminopolyalkylene glycol.

U.S. Pat. No. 4,683,069 (Brewster et al.) discloses lubricating oil compositions containing a glycerol partial ester of a fatty acid.

U.S. Pat. No. 4,491,455 (Ishizaki et al.) teaches adding esters of nitrogen containing compounds having polyhydroxyl groups with linear saturated fatty acids to fuel oils in order to improve cold flow.

U.S. Pat. No. 4,253,876 (Godar et al.) discloses corrosion inhibitors comprising triesters of an alkenyl or alkyl succinic acid or anhydride and a trialkanolamine.

SUMMARY OF THE INVENTION

It has now been found that the lubricating properties of low sulfur-content fuels can be improved by the use of certain additive compounds as described in detail below. This enables mechanical failure, for example fuel injector pump failure, caused by inadequate fuel lubricity to be avoided while retaining the environmental benefit of using a low sulfur fuel.

In the present context the term "low sulfur-content fuel" is intended to mean fuels typically having a sulfur content of 0.2% by weight or less, for example 0.05% by weight or less and, more especially, 0.005% by weight or less. Examples of fuels in which the additive compounds may be used include low sulfur middle distillate fuels such as diesel and jet fuels and bio-diesel fuel. The latter is derived from a petroleum or vegetable source or mixture thereof and typically contains vegetable oils or their derivatives, such as esters produced by saponification and re-esterification or trans-esterification. Middle distillate fuels are usually characterized as having a boiling range of 100 to 500° C., more typically from 150 to 400° C.

DETAILED DESCRIPTION

In accordance with the present invention the additive compound used to improve the lubricity of low sulfur-content fuel is selected from the group consisting of a) a carboxylic acid which is substituted by at least one hydroxy group, b) a derivative of this hydroxy-substituted acid, wherein the derivative may be an ester formed by reaction of the acid with a polyhydric alcohol or alkanolamine, or an amide, and c) a carboxylic acid ester which is an ester formed from the reaction of a carboxylic acid which does not contain any hydroxy-substitution in the acid backbone and an alkanolamine.

The hydroxy-substituted carboxylic acid or acid derivative may be used alone or in combination with any other hydroxy-substituted acid and/or acid derivative. The hydroxy-substituted acid used in the present invention typically contains up to 60 carbon atoms. The hydroxy-substituted acid may be a mono- or poly-carboxylic acid or a dimerized acid. When hydroxy-substituted monocarboxylic acids are used they typically contain 10 to 40 carbon atoms, more commonly 10 to 30 and especially 12 to 24 carbon atoms. The preferred acid of this type is the fatty acid, ricinoleic acid. When hydroxy-substituted polycarboxylic acids are used, such as di- or tri-carboxylic acids, they typically contain 3 to 40 carbon atoms, more commonly 3 to 30 and especially 3 to 24 carbon atoms. Examples of this kind of hydroxy-substituted poly-carboxylic acid include malic, tartaric and citric acids. It is also possible to use as the hydroxy-substituted acid, dimerized acids. Herein such compounds are referred to as dimer and trimer acids. When used the dimerized acid typically contains 10 to 60, preferably 20 to 60 and most preferably 30 to 60, carbon atoms. Such acids are prepared by dimerizing unsaturated acids and introducing a hydroxyl functionality. Such acids typically consist of a mixture of monomer, dimer and trimer acid. According to a preferred embodiment of the invention the acid is a hydroxy-substituted dimerized fatty acid, for example of oleic and linoleic acids. Typically this dimer exists as a mixture of 2% by weight monomer, 83% by weight dimer and 15% by weight of trimer and possibly higher acids. The preferred dimer acid, as well as the other acids described above, are commercially available or may be prepared by the application or adaptation of known techniques.

As described above, the additive compound(s) used may be in the form of a carboxylic acid derivative. One kind of derivative which may be used is an ester of the acid with a polyhydric alcohol. The polyhydric alcohol from which the ester may be derived typically contains from 2 to 7 carbon atoms. Examples of suitable alcohols include alkylene glycols such as ethylene glycol, diethylene glycol, triethylene glycol and dipropylene glycol, glycerol, arabitol, sorbitol, mannitol, pentaerythritol, sorbitan, 1,2-butanediol, 2,3-hexanediol, 2,4-hexanediol, pinacol and 1,2-cyclohexanediol. These alcohols are readily available. Of the alcohols mentioned it is preferred to use glycerol or sorbitan. in a preferred embodiment the ester has at least one free hydroxyl group in the moiety derived from the polyhydric alcohol, i.e. not all of the hydroxyl groups of the polyhydric alcohol are esterified. The use of glycerol monoricinoleate is particularly preferred.

Another kind of fatty acid derivative which may be used is the ester of the hydroxy-substituted acid with an alkanolamine of formula:

$$R^1[N(R^1)(CH_2)_p]_qY$$

in which p is 2 to 10, q is 0 to 10, Y is $—N(R^1)_2$, 4-morpholinyl or 1-piperazinyl N-substituted by a group $R^1$ or a group $—[(CH_2)_pN(R^1)]_qR^1$ in which p and q are as defined above and each substituent $R^1$ is independently selected from alkyl groups having from 1 to 6 carbon atoms and a group of formula:

$$—(R^2O)_rR^3$$

in which r is 0 to 10, $R^2$ is an alkylene group having 2 to 6 carbon atoms and $R^3$ is an hydroxyalkyl group having 2 to 6 carbon atoms, provided at least one group $R^1$ is $—(R^2O)_rR^3$. Thus, the alkanolamine is one which does not contain any hydrogen-bearing nitrogen atoms. The presence of free hydrogen atoms would be expected to lead to the formation of an amide on reaction with the acid. The alkanolamines which may be used are commercially available or may be made by the application or adaptation of known methods.

According to a preferred embodiment, in the alkanolamine of the above formula Y is $—N(R^1)_2$, p is 2 and q is 0 to 3. It is further preferred that each $R^1$ is a $C_{2-4}$ hydroxyalkyl group, $C_2$ or $C_3$ hydroxyalkyl being particularly preferred. Specific examples of such compounds include triethanolamine, triisopropylamine and ethylene diamine and diethylene triamine in which each nitrogen atom is substituted by hydroxyethyl or hydroxypropyl groups.

In another preferred embodiment, in the alkanolamine Y is 4-morpholinyl or substituted 1-piperazinyl, q is 0 or 1 and p is from 2 to 6. Examples of such alkanolamines include aminoethylpiperazine, bis-(aminoethyl)piperazine and morpholine, N-substituted by an hydroxypropyl group.

The alkanolamines are commercially available or may be made by the application or adaptation of known techniques.

It is also possible to use as the hydroxy-substituted acid derivative, an amide such as that formed by reaction of the substituted fatty acid with ammonia or a nitrogen-containing compound of formula:

$$R^1[N(R^1)(CH_2)_p]_qY$$

in which p is 2 to 10, q is 0 to 10, Y is $—N(R^1)_2$, 4-morpholinyl or 1-piperazinyl optionally N-substituted by a group $R^1$ or a group $—[(CH_2)_pN(R^1)]_qR^1$ in which p and q are as defined above and each substituent $R^1$ is independently selected from hydrogen and alkyl groups having 1 to 6 carbon atoms and a group of formula:

$$—(R^2O)_rR^3$$

in which r is 0 to 10, $R^2$ is an alkylene group having 2 to 6 carbon atoms and $R^3$ is an hydroxyalkyl group having 2 to 6 carbon atoms, provided that at least one group $R^1$ is hydrogen.

According to a preferred embodiment, in the nitrogen-containing compound Y is $—N(R^1)_2$, p is 2 and q is 0 to 3. Examples of such compounds include diethanolamine, tris (hydroxymethyl)aminomethane, triethylene tetramine or diethylene triamine optionally N-substituted by two hydroxypropyl groups.

In another embodiment, in the nitrogen-containing compound Y is 4-morpholinyl or optionally N-substituted 1-piperazinyl, p is 2 to 6, q is 0 or 1 and each $R^1$ is hydrogen. Examples of such compounds include aminoethylpiperazine, bis-(aminoethyl)piperazine or morpholine.

The compounds used to form the acid amides are commercially available or may be made by the application or adaptation of known techniques.

The alkanolamines and nitrogen-containing compounds of the above formulae in which r is 1 or more, i.e. those containing an ether or polyether linkage, can be prepared by reaction of a suitable amine, morpholine or piperazine compound with a molar excess of one or more alkylene oxides. When the same kind of alkylene oxide is used $R^2$ and $R^3$ contain the same alkylene moiety. When different kinds of alkylene oxides are used $R^2$ and $R^3$ may contain the same or different alkylene groups.

In the formulae for the alkanolamine compound p is 2 to 10, preferably 2 or 3, q is 0 to 10, preferably 0 to 5 and r is 0 to 15, preferably 0 to 10. When $R^1$ is alkyl the moiety contains from 1 to 6 carbon atoms, preferably 2 to 4 carbon atoms. $R^2$ is an alkylene group having 2 to 6 carbon atoms, preferably 2 to 4 carbon atoms. $R^3$ is an hydroxyalkyl group having 2 to 6 carbon atoms, preferably 2 to 4 carbon atoms. The hydroxyalkyl group typically contains 1 to 3 hydroxy groups. When r is greater than zero $R^3$ is typically a mono-hydroxyalkyl group, for example hydroxyethyl or hydroxypropyl. When r is zero $R^3$ is typically a mono- or poly-hydroxyalkyl group having up to 4 hydroxyl groups, for example hydroxyethyl, hydroxypropyl or a 1-hydroxy-2,2-bis(hydroxymethyl)ethyl group. The values p, q and r take are selected independently. This means for example that when q is greater than zero, p may take different values in each repeat unit. Also, when r is greater than zero, $R^2$ may be the same or different in each ether repeat unit.

Each of the acid derivatives described are commercially available or may be made by the application or adaptation of known techniques. When used in the form of a derivative it is preferred that the derivative is one derived from ricinoleic acid.

The acid used in the present invention which does not contain any hydroxy-substitution in the acid backbone typically contains up to 60 carbon atoms. The acid may be a mono- or poly-carboxylic acid or a dimerized acid. When mono-carboxylic acids are used they typically contain 10 to 40 carbon atoms, more commonly 10 to 30 and especially 12 to 24 carbon atoms. Examples of such include aliphatic fatty acids such as lauric, myristic, heptadecanoic, palmitic, stearic, oleic, linoleic, linolenic, nonadecanoic, arachic or behenic acid. Of these the use of oleic acid is preferred. When poly-carboxylic acids are used, such as di- or tri-carboxylic acids, they typically contain 3 to 40 carbon atoms, more commonly 3 to 30 and especially 3 to 24 carbon atoms. Examples of this kind of poly-carboxylic acid include dicarboxylic acids such as succinic, glutaric, adipic, suberic, azelaic or sebacic acid, and tricarboxylic acids such as 1,3,5-cyclohexane tricarboxylic acid and tetracarboxylic acids such as 1,2,3,4-butane tetracarboxylic acid.

It is also possible to use as the acid containing no hydroxy substitution in the backbone, dimerized acids. Herein such compounds are referred to as dimer and trimer acids. When used the dimerized acid typically contains 10 to 60, preferably 20 to 60 and most preferably 30 to 60, carbon atoms. Such acids are prepared by dimerizing unsaturated acids and typically consist of a mixture of monomer, dimer and trimer acid. According to a preferred embodiment of the invention the acid is a dimerized fatty acid, for example of oleic and linoleic acids. Typically this dimer exists as a mixture of 2% by weight monomer, 83% by weight dimer and 15% by weight of trimer and possibly higher acids. The preferred dimer acid, as well as the other acids described above, are commercially available or may be prepared by the application or adaptation of known techniques.

The alkanolamine used to form the ester used in the present invention is typically of formula:

$$R^1[N(R^1)(CH_2)_p]_qY$$

in which p is 2 to 10, preferably 2 or 3, q is 0 to 10, preferably 0 to 5, Y is $—N(R^1)_2$, 4-morpholinyl or 1-piperazinyl N-substituted by a group $R^1$ or a group $—[(CH_2)_pN(R^1)]_qR^1$ in which p and q are as defined above and each substituent $R^1$ is independently selected from alkyl groups having from 1 to 6 carbon atoms, preferably 2 to 4 carbon atoms, and a group of formula:

$$(R^2O)_rR^3$$

in which r is 0 to 15, preferably 0 to 10, $R^2$ is an alkylene group having from 2 to 6 carbon atoms, preferably 2 to 4 carbon atoms, $R^3$ is an hydroxyalkyl group having 2 to 6 carbon atoms, preferably 2 to 4 carbon atoms, and provided at least one group $R^1$ is $(R^2O)_rR^3$. The hydroxyalkyl group typically contains 1 to 3 hydroxy groups. When r is greater than zero $R^3$ is typically a mono-hydroxyalkyl group, for example hydroxyethyl or hydroxypropyl. When r is zero $R^3$ is typically a mono- or poly-hydroxyalkyl group having up to 4 hydroxy groups, for example hydroxyethyl, hydroxypropyl or a 1-hydroxy-2,2-bis(hydroxymethyl)ethyl group. The values p, q and r take are selected independently. This means for example that when q is greater than zero, p may take different values in each repeat unit. Also, when r is greater than zero, $R^2$ may be the same or different in each ether repeat unit. Thus, the alkanolamine is one which does not contain any hydrogen-bearing nitrogen atoms. The presence of such free hydrogen atoms on the nitrogen would be expected to lead to the formation of an amide on reaction with the fatty acid.

The alkanolamines which may be used to form the ester are commercially available or may be made by the application or adaptation of known techniques. For example, the alkanolamines in which r is 1 or more, i.e. those containing an ether or polyether linkage, can be prepared by reaction of a suitable amine, morpholine or piperazine compound with a molar excess of one or more alkylene oxides. When the same kind of alkylene oxide is used $R^2$ and $R^3$ contain the same alkylene moiety. When different kinds of alkylene oxide are used $R^2$ and $R^3$ may contain the same or different alkylene groups.

According to a preferred embodiment, alkanolamines of the above formula are used in which Y is $—N(R^1)_2$, p is 2 and q is 0 to 3. Preferably the alkanolamine is triethanolamine or triisopropylamine or ethylene diamine or diethylene triamine in which each nitrogen atom is substituted by hydroxyethyl or hydroxypropyl groups.

According to an alternative preferred embodiment, in the formula shown above, Y is 4-morpholinyl or substituted 1-piperazinyl, p is 2 to 6 and q is 0 or 1. Examples of such alkanolamines include aminoethylpiperazine, bis-(aminoethyl)piperazine or morpholine, N-substituted by an hydyroxypropyl group.

The esters described may be made by the application or adaptation of known techniques, or are commercially available ready for use.

According to one aspect of the present invention, the lubricity enhancing additive compound is a derivative of the hydroxy-substituted acid and contains at least one free carboxylic group in the acid-derived moiety. This kind of compound may be formed using as the starting hydroxy-substituted acid a polycarboxylic acid, for example a dicarboxylic acid or a dimer or trimer acid. Suitably, the number of moles of the acid and compound used to form the acid derivative which are reacted is controlled such that the resulting compound contains at least one free carboxylic functional group in the acid-derived moiety. For example, if an acid having two carboxylic functions is used, such as a dicarboxylic or dimer acid, the mole ratio should be about 1:1.

According to another aspect of the present invention, the ester contains at least one free carboxylic group in the acid-derived moiety and no hydroxy substitution in the acid backbone. This kind of compound may be formed using as the starting acid a polycarboxylic acid, for example a dicarboxylic acid or a dimer or trimer acid. Suitably, the number of moles of acid and alkanolamine which are reacted is controlled such that the resulting ester contains at least one free carboxylic functional group in the acid derived-moiety. For example, if an acid having two carboxyl functions is used, such as a dicarboxylic or dimer acid, the mole ratio could be about 1:1.

In the case that the acid derivative contains at least one free carboxylic group in the acid moiety, it may be used as is or it may be derivatised further to enhance its properties. The kind of compound used to do this usually depends upon the kind of acid used initially and the properties of the acid derivative it is desired to influence. For example, it is possible to increase the fuel solubility of the acid derivative by introducing into its molecule a fuel-solubilizing species. As an example of such, long-chain alkyl or alkenyl may be mentioned. To this end the acid derivative may be reacted with an alcohol, ROH or an amine, $RNH_2$ in which R is alkyl or alkenyl having up to 30 carbon atoms, for example 4 to 30 carbon atoms. The number of carbon atoms in the alkyl or alkenyl group may depend upon the number of carbon atoms in the acid derivative itself. These compounds react with the free carboxylic functional group(s) of the acid derivative to form a further ester linkage or an amide linkage. Examples of particular alcohols and amides which may be used include oleyl amine and oleyl alcohols.

Alternatively, it is possible to further react the acid derivative to introduce into its molecule one or more polar head groups. This has the result of increasing the lubricity enhancing effect which the acid derivative exhibits. This is believed to be due to the polar head group increasing the affinity of the acid derivative to metal surfaces. Examples of compounds which may be used to introduce one or more polar head groups include polyamines (e.g. ethylene diamine and diethylene triamine), monohydric alcohols (e.g., ethanol and propanol) and alkanolamines and polyhydric alcohols such as those described above.

Typically, unless the fatty acid derivative is one derived from a dimer or trimer acid, the derivative is further reacted to introduce fuel-solubilising species. Dimer and trimer acid derivatives tend already to contain in the acid backbone long chain alkyl or alkenyl moieties sufficient to provide adequate fuel-solubility.

While it has been described above that it is the acid derivative which is reacted further, it is quite possible that the same final species can be formed by first reacting free carboxylic functional group(s) of a polycarboxylic acid to introduce fuel-solubilising or polar head groups and then reacting the resultant product to form the acid derivative. Of course, this assumes that the product formed after the initial reaction contains at least one free carboxylic group in the acid-derived moiety such that acid derivative formation is still possible.

Typically, the concentration of the lubricity enhancing additive in the fuel falls in the range 10 to 1000 ppm, preferably 50 to 500 ppm, more preferably still from 100 to 400 ppm. When mixtures of additives are used the overall additive concentration falls within the typical range quoted.

The present invention further provides a low sulfur fuel comprising a lubricity enhancing additive as hereinbefore described. Such fuel is formulated by simple mixing of the base fuel and the additive in the desired proportions. The base fuel may be a middle distillate fuel or a bio-diesel fuel as described above For the sake of convenience, the additive may be provided as a concentrate for dilution with fuel. Such a concentrate forms part of the present invention and typically comprises from 99 to 1% by weight additive and from 1 to 99% by weight of solvent or diluent for the additive which solvent or diluent is miscible and/or capable of dissolving in the fuel in which the concentrate is to be used. The solvent or diluent may, of course, be the low sulfur fuel itself. However, examples of other solvents or diluents include white spirit, kerosene, alcohols (e.g. 2-ethyl hexanol, isopropanol and isodecanol), high boiling point aromatic solvents (e.g. toluene and xylene) and cetane improvers (e.g. 2-ethyl hexylnitrate). Of course, these may be used alone or as mixtures.

The concentrate or fuel may also contain other fuel additives in the appropriate proportions thereby providing a multifunctional fuel additive package. Examples of conventional fuel additives which may be used include fuel stabilizers, dispersants, detergents, antifoams, cold flow improvers, cetane number improvers, antioxidants, corrosion inhibitors, antistatic additives, biocides, dyes, smoke reducers, catalyst life enhancers and demulsifiers. The total treat rate for multifunctional formulations containing the lubricity enhancing additive compounds described is typically 200 to 2000 ppm, more usually 300 to 1200 ppm.

The invention also provides a method of reducing fuel pump wear in an engine which operates on a low sulfur-content fuel by using the low sulfur-content fuel described herein. The fuel may be used to reduce wear in rotary and in-line fuel pumps, for example as found in diesel engines, or in fuel transfer pumps. The latter are positioned between the fuel tank and the high pressure pump. The fuel is particularly well suited for reducing wear in fuel injector pumps. The fuel may also be used in the latest unit injectors which combine pump and injector mechanisms. The invention is particularly well-suited to the operation of diesel and jet engines.

The present invention is illustrated in the following Examples.

EXAMPLES

The efficacy of a number of diesel fuels was assessed using the Scuffing BOCLE (ball-on-cylinder lubricity evaluator) test. This test is a modification of the standard aviation BOCLE test (ASTM method D5001: "Standard Test Method for Measurement of Lubricity of Aviation Turbine Fuels by the Ball-on-Cylinder Lubricity Evaluator (BOCLE)", ASTM Standards, Section 5, Vol 3, 1993) in which a load of 1 kg is applied to a fixed ball in contact with a rotating cylinder lubricated by the test fuel. In this standard test fuel lubricity is assessed by measuring the size of the wear scar on the fixed ball resulting from the constant load contact with the cylinder. However, the standard BOCLE test suffers the disadvantage that the applied load is not high enough to model the type of severe wear failure that occurs in the field, for example in fuel injector pumps.

The Scuffing BOCLE test offers the advantage over the standard test of allowing discrimination and ranking of fuels of differing lubricity. The Scuffing test also simulates more closely the severe modes of wear failure encountered in fuel pumps than other fuel lubricity tests which run under mild wear conditions. The Scuffing BOCLE test therefore provides results which are more representative of how the fuel would behave in service.

In the Scuffing BOCLE test a load (0.25–8.0 kg) is applied to a fixed ball in contact with a rotating cylinder. The ball and cylinder are made of a standard grade steel. The cylinder rotates at 290 rpm. Since the temperature of the lubricating fuel can have a marked effect on the scuffing load, this is carefully controlled at 25° C. A nitrogen atmosphere is used to blanket the ball on cylinder assembly. Following a one minute run-in period the load is applied to the ball for two minutes. After this run, the ball is removed from the assembly and the type and size of wear scar examined by microscope. Further runs are then carried using increased applied loads in a stepwise manner until scuffing wear failure occurs. The load at which wear failure occurs is referred to as the scuffing load and is a measure of the inherent lubricity of the fuel. The scuffing load is primarily identified by the size and appearance of the wear scar on the ball, which is considerably different in appearance to that found under milder non-scuffing conditions. Fuels giving a high scuffing load on failure have better lubricating properties than fuels giving a low scuffing load on failure.

The base fuel used was a Class 2 Scandinavian diesel fuel. This is a diesel fuel having a sulfur content of 0.005% by weight. The composition and distillation profile of this fuel are shown below.

| | |
|---|---|
| Density at 15° C. (IP 160), g/ml | 0.82 |
| Paraffins, % vol | 89.6 |
| Olefins, % vol | 0.7 |
| Aromatics, % vol | 9.7 |
| Distillation Characteristics (IP 123) | |
| Initial B.P., °C. | 184 |
| 5% | 200 |
| 10% | 204 |
| 20% | 212 |
| 30% | 217 |
| 40% | 223 |
| 50% | 228 |
| 60% | 235 |
| 70% | 243 |
| 80% | 251 |
| 90% | 263 |
| 95% | 269 |
| Final B.P., °C. | 290 |
| Recovered, % | 99 |
| Residue, % | 1 |
| Loss, % | 0 |

The table below shows the Scuffing BOCLE test results for a number of diesel fuel compositions. Samples C, E–G, I and, K–N are fuels in accordance with the present invention. Samples A, B, D, H and J are included for comparison.

| Additive | Concentration (ppm) | Scuffing load (kg) |
|---|---|---|
| A. None | — | 2.7 |
| B. Oleic acid | 200 | 3.1 |
| C. Ricinoleic acid | 200 | 4.2 |
| D. Glycerol monooleate | 200 | 3.4 |
| E. Glycerol monoricinoleate | 100 | 3.8 |
| F. Glycerol monoricinoleate | 200 | 4.1 |
| G. Glycerol monoricinoleate | 400 | 5 |
| H. Amide: Oleic acid + DETA | 200 | 3.1 |
| I. Amide: Ricinoleic acid + | 200 | 4.6 |

-continued

| Additive | Concentration (ppm) | Scuffing load (kg) |
|---|---|---|
| DETA | | |
| J. Amide: Oleic acid + DETA.2PO | 200 | 2.8 |
| K. Amide: Ricinoleic acid + DETA.2PO | 200 | 4 |
| L. Amide: Ricinoleic acid + DEA | 200 | 4.2 |
| M. Amide: Ricinoleic acid + TETA | 200 | 4.7 |
| N. Amide: Ricinoleic acid + THAM | 200 | 4.4 |

In the table above:
DEA stands for diethanolamine;
THAM stands for tris(hydroxymethyl)aminomethane;
DETA stands for diethylene triamine;
DETA.2PO indicates that the DETA is N-substituted by two hydroxypropyl groups; and
TETA stands for triethylene tetramine.

In runs D–N the mole ratio of fatty acid: derivatising species was in each case 1:1.

These results clearly demonstrate the improvement in lubricity of diesel fuels in accordance with the present invention. The base fuel used has a very low inherent lubricity giving a low scuffing load result of 2.7 kg. The addition of 200 ppm of oleic acid, i.e. a $C_{18}$ unsubstituted fatty acid, leads to a slight improvement in lubricity performance exhibited as a higher scuffing load on failure of 3.1 kg. Formulations of base fuel and the corresponding hydroxy-substituted $C_{18}$ acid (ricinoleic acid) leads to significantly improved scuffing performance of 4.2 kg (run C). The free hydroxyl group in the 12-position of the ricinoleic acid tail is believed to be responsible for this. Good results are also obtained for the fuels of runs L, M and N which are in accordance with the present invention.

The table below shows the Scuffing BOCLE test results for a number of diesel fuels. Samples B–E are fuels in accordance with the present invention. Sample A is included for comparison.

| Additive | Concentration (ppm) | Scuffing load (kg) |
|---|---|---|
| A. None | — | 2.7 |
| B. Ester: Dimer acid + TEA | 200 | 7.4 |
| C. Ester: Dimer acid + TIPA | 200 | 5.6 |
| D. Ester: Dimer acid + EDA.4PO | 200 | 5.7 |
| E. Ester: Dimer acid + DETA.5PO | 200 | 5.7 |
| F. Ester: Dimer acid + EDA.9PO | 200 | 4.8 |
| G. Ester: Dimer acid + EDA.9PO then DETA | 200 | 5.1 |
| H. Ester: Dimer acid + EDA.9PO then TETA | 200 | 5.9 |

The dimer acid used is formed from oleic and linoleic acids and is commercially available from Union Camp under the name Unidyme 22. In the table above:
TEA stands for triethanolamine;
TIPA stands for triisopropanolamine;
EDA stands for ethylene diamine;
EDA.XPO indicates that each mole of EDA is reacted with X moles of propylene oxide;
DETA stands for diethylene triamine;
TETA stands for triethylene tetramine;
DETA.5PO indicates that each mole of DETA is reacted with five moles of propylene oxide.

In runs B–E the mole ratio of dimer acid: alkanolamine was in each case 1:2. In runs F–H the mole ratio of dimer acid:alkanolamine was 1:1. In runs G and H the ester is derivatised further by reaction with DETA and TETA respectively.

These results clearly demonstrate the improvement in lubricity of diesel fuels in accordance with the present invention. The base fuel used has a very low inherent lubricity giving a low scuffing load result of 2.7 kg. The addition of 200 ppm of additive in accordance with the present invention leads to a significant improvement in lubricity performance exhibited as a higher scuffing load on failure. As can be seen from the table above the additives used in accordance with the present invention lead to a scuffing load on failure which is significantly higher than the load on failure observed for the base fuel.

What is claimed is:

1. A low sulfur-content fuel composition comprising a low sulfur-content middle distillate fuel, wherein the sulfur content of the low sulfur-content middle distillate fuel is 0.2% by weight or less, and from 10 to 1000 ppm of an additive compound, to improve the lubricity of said fuel, selected from the group consisting of a) carboxylic acids substituted by at least one hydroxy group and b) a derivative of said hydroxy-substituted carboxylic acid, wherein said carboxylic acids of components (a) and (b) are hydroxy-subtituted dimerized fatty acids having from 10 to 60 carbon atoms, and wherein the derivative of said hydroxy-substituted carboxylic acid is selected from the group consisting of i) the reaction product of said hydroxy-substituted carboxylic acid and an alkanolamine, wherein the alkanolamine is of the formula:

$$R^1[N(R^1)(CH_2)_p]_qY$$

in which p is 2 to 10, q is 0 to 10, Y is $—N(R^1)_2$, 4-morpholinyl or 1-piperazinyl N-substituted by a group $R^1$ or a group $—[(CH_2)_pN(R^1)]_qR^1$ in which p and q are as defined above and each substituent $R^1$ is independently selected from alkyl groups having from 1 to 6 carbon atoms and a group of formula:

$$—(R^2O)_rR^3$$

in which r is 0 to 10, $R^2$ is an alkylene group having 2 to 6 carbon atoms and $R^3$ is a hydroxyalkyl group having 2 to 6 carbon atoms, provided at least one group $R^1$ is $—(R^2O)_rR^3$;

ii) the reaction product of said hydroxy-substituted carboxylic acid and ammonia;

iii) the reaction product of said hydroxy-substituted carboxylic acid and a nitrogen-containing compound of the formula:

$$R^1[N(R^1)(CH_2)_p]_qY$$

in which p is 2 to 10, q is 0 to 10, Y is $—N(R^1)_2$, 4-morpholinyl or 1-piperazinyl optionally N-substituted by a group $R^1$ or a group $—[(CH_2)N(R^1)]_qR^1$ in which p and q are as defined above and each substituent $R^1$ is independently selected from hydrogen and alkyl groups having 1 to 6 carbon atoms and a group of formula:

$$—(R^2O)_rR^3$$

in which r is 0 to 10, $R^2$ is an alkylene group having 2 to 6 carbon atoms and $R^3$ is a hydroxyalkyl group having 2 to 6 carbon atoms, provided at least one group $R^1$ is hydrogen.

2. The low sulfur-content fuel composition of claim 1 wherein the middle distillate fuel is selected from the group consisting of diesel fuel, jet fuel and bio-diesel fuel.

3. The low sulfur-content fuel composition of claim 1 wherein the dimerized fatty acid is a dimer acid of oleic and linoleic acid.

4. The low sulfur-content fuel composition of claim 1 wherein the sulfur content of the fuel is 0.05% by weight or less.

5. The low sulfur-content fuel composition of claim 1 wherein the acid has from 10 to 60 carbon atoms.

6. The low sulfur-content fuel composition of claim 1 wherein Y is $—N(R^1)_2$, p is 2 and q is 0 to 3.

7. The low sulfur-content fuel composition of claim 6 wherein the alkanolamine is triethanolamine, triisopropylamine or ethylene diamine or diethylene triamine in which each nitrogen atom is substituted by hydroxyethyl or hydroxypropyl groups.

8. The low sulfur-content fuel composition of claim 1 wherein Y is 4-morpholinyl or substituted 1-piperazinyl, p is 2 to 6 and q is 0 or 1.

9. The low sulfur-content fuel composition of claim 8 wherein the alkanolamine is (aminoethyl)piperazine, bis-(aminoethyl)piperazine or morpholine, N-substituted by a hydroxypropyl group.

10. The low sulfur-content fuel composition of claim 1 wherein in the nitrogen-containing compound Y is $—N(R^1)_2$, p is 2 and q is 0 to 3.

11. The low sulfur-content fuel composition of claim 10 wherein the nitrogen-containing compound is diethanolamine, tris(hydroxymethyl)aminomethane, triethylene tetramine or diethylene triamine optionally N-substituted by two hydroxypropyl groups.

12. The low sulfur-content fuel composition of claim 1 wherein in the nitrogen-containing compound Y is 4-morpholinyl or optionally N-substituted 1-piperazinyl, p is 2 to 6, q is 0 or 1 and each $R^1$ is hydrogen.

13. The low sulfur-content fuel composition of claim 12 wherein the nitrogen-containing compound is aminoethylpiperazine, bis-(aminoethyl)piperazine or morpholine.

14. The low sulfur-content fuel composition of claim 1 wherein the derivative of said hydroxy-substituted carboxylic acid contains at least one free carboxyl group in the acid-derived moiety.

15. The low sulfur-content fuel composition of claim 14 wherein the additive compound is further derivatized by reaction with a compound selected from the group consisting of ROH and $RNH_2$, wherein R is alkyl or alkenyl having from 4 to 30 carbon atoms.

16. The low sulfur-content fuel composition of claim 14 wherein the additive compound is further derivatised by reaction with a compound selected from the group consisting of polyamines, monohydric alcohols, alkanol amines and polyhydric alcohols.

17. The low sulfur-content fuel composition of claim 1 wherein additive compound is present in the fuel at a concentration of from 100 to 400 ppm.

18. An additive concentrate for use in low sulfur-content middle distillate fuel comprising from 99 to 1% by weight of an additive compound as defined in claim 1, and from 1 to 99% by weight of solvent or diluent for the additive compound which solvent or diluent is miscible and/or capable of dissolving in the fuel in which the concentrate is to be used.

19. A method of improving the lubricity of a low sulfur-content fuel and reducing pump wear in an engine which operates on said low sulfur-content middle distillate fuel, said method comprising adding to said low sulfur-content fuel from 10 to 1000 ppm of an additive selected from the group consisting of a) carboxylic acids substituted by at least one hydroxy group and b) a derivative of said hydroxy-substituted carboxylic acid, wherein said carboxylic acids of components (a) and (b) are hydroxy-subtituted dimerized fatty acids having from 10 to 60 carbon atoms, and wherein the derivative of said hydroxy-substituted carboxylic acid is selected from the group consisting of i) the reaction product of said hydroxy-substituted carboxylic acid and an alkanolamine, wherein said alkanolamine is of the formula:

$$R^1[N(R^1)(CH_2)_p]_qY$$

in which p is 2 to 10, q is 0 to 10, Y is $—N(R^1)_2$, 4-morpholinyl or 1-piperazinyl N-substituted by a group $R^1$ or a group $—[(CH_2)_pN(R^1)]_qR^1$ in which p and q are as defined above and each substituent $R^1$ is independently selected from alkyl groups having from 1 to 6 carbon atoms and a group of formula:

$$—(R^2O)_rR^3$$

in which r is 0 to 10, $R^2$ is an alkylene group having 2 to 6 carbon atoms and $R^3$ is a hydroxyalkyl group having 2 to 6 carbon atoms, provided at least one group $R_1$ is $—(R^2O)_rR^3$;

ii) the reaction product of said hydroxy-substituted carboxylic acid and ammonia;

iii) the reaction product of said hydroxy-substituted carboxylic acid and a nitrogen-containing compound of the formula:

$$R^1[N(R^1)(CH_2)_p]_qY$$

in which p is 2 to 10, q is 0 to 10, Y is $—N(R^1)_2$, 4-morpholinyl or 1-piperazinyl optionally N-substituted by a group $R^1$ or a group $—[(CH_2)_pN(R^1)]_qR^1$ in which p and q are as defined above and each substituent $R^1$ is independently selected from hydrogen and alkyl groups having 1 to 6 carbon atoms and a group of formula:

$$—(R^2O)_rR^3$$

in which r is 0 to 10, $R^2$ is an alkylene group having 2 to 6 carbon atoms and $R^3$ is a hydroxyalkyl group having 2 to 6 carbon atoms, provided at least one group $R^1$ is hydrogen.

* * * * *